US010909920B2

(12) United States Patent
Zhu et al.

(10) Patent No.: US 10,909,920 B2
(45) Date of Patent: Feb. 2, 2021

(54) PIXEL DRIVING CIRCUIT, PIXEL DRIVING METHOD, AND DISPLAY DEVICE

(71) Applicants: BOE TECHNOLOGY GROUP CO., LTD., Beijing (CN); ORDOS YUANSHENG OPTOELECTRONICS CO., LTD., Inner Mongolia (CN)

(72) Inventors: Jianchao Zhu, Beijing (CN); Lujiang Huangfu, Beijing (CN); Yunfei Li, Beijing (CN); Can Zheng, Beijing (CN); Libin Liu, Beijing (CN); Yipeng Chen, Beijing (CN)

(73) Assignees: BOE TECHNOLOGY GROUP CO., LTD., Beijing (CN); ORDOS YUANSHENG OPTOELECTRONICS TECHNOLOGY CO., LTD., Inner Mongolia (CN)

( * ) Notice: Subject to any disclaimer, the term of this patent is extended or adjusted under 35 U.S.C. 154(b) by 79 days.

(21) Appl. No.: 16/309,203

(22) PCT Filed: Mar. 20, 2018

(86) PCT No.: PCT/CN2018/079681

§ 371 (c)(1),
(2) Date: Dec. 12, 2018

(87) PCT Pub. No.: WO2018/210051

PCT Pub. Date: Nov. 22, 2018

(65) Prior Publication Data

US 2019/0266946 A1 Aug. 29, 2019

(30) Foreign Application Priority Data

May 18, 2017 (CN) ..... 2017 1 0353350

(51) Int. Cl.
*G09G 3/3233* (2016.01)
*G09G 3/3266* (2016.01)

(52) U.S. Cl.
CPC ..... *G09G 3/3233* (2013.01); *G09G 3/3266* (2013.01); *G09G 2300/0426* (2013.01);
(Continued)

(58) Field of Classification Search
CPC ... G09G 2300/0426; G09G 2300/0819; G09G 2300/0852; G09G 2300/0861;
(Continued)

(56) References Cited

U.S. PATENT DOCUMENTS 8,570,249 B2 10/2013 Han
2009/0108763 A1* 4/2009 Han ..... G09G 3/3233 315/169.3
(Continued)

FOREIGN PATENT DOCUMENTS

CN 104992674 A 10/2015
CN 105225636 A 1/2016
(Continued)

OTHER PUBLICATIONS

Search Report and Written Opinion for International Application No. PCT/CN2018/079681 dated Jun. 15, 2018.

*Primary Examiner* — Kenneth Bukowski
(74) *Attorney, Agent, or Firm* — Calfee, Halter & Griswold LLP

(57) ABSTRACT

A pixel driving circuit and a driving method, and a display device are provided. The driving circuit includes: a first switching element, a second switching element, a third switching element, a fourth switching element, a fifth switching element, a driving transistor, a sixth switching element, a first storage capacitor and a second storage capacitor.

20 Claims, 5 Drawing Sheets

(52) U.S. Cl.
CPC ..... *G09G 2300/0819* (2013.01); *G09G 2300/0852* (2013.01); *G09G 2320/0233* (2013.01)

(58) Field of Classification Search
CPC ..... G09G 2320/0233; G09G 2320/045; G09G 3/3233; G09G 3/3266
See application file for complete search history.

(56) References Cited

U.S. PATENT DOCUMENTS

| | | | | |
|---|---|---|---|---|
| 2011/0090213 | A1 | 4/2011 | Han | |
| 2016/0253959 | A1* | 9/2016 | Sun | G09G 3/3225 345/212 |
| 2017/0025062 | A1* | 1/2017 | Wang | G09G 3/3233 |
| 2017/0193908 | A1 | 7/2017 | Wang | |

FOREIGN PATENT DOCUMENTS

| | | | |
|---|---|---|---|
| CN | 105489166 | A | 4/2016 |
| CN | 105609048 | A | 5/2016 |
| CN | 205541822 | U | 8/2016 |
| CN | 106952617 | A | 7/2017 |
| KR | 101178911 | B1 | 8/2012 |

* cited by examiner

PIXEL DRIVING CIRCUIT, PIXEL DRIVING METHOD, AND DISPLAY DEVICE

CROSS REFERENCE

The present application is based upon International Application No. PCT/CN2018/079681, filed on Mar. 20, 2018, which is based upon and claims priority to Chinese Patent Application No. 201710353350.X, filed on May 18, 2017, and the entire contents thereof are incorporated herein by reference.

TECHNICAL FIELD

The present disclosure relates to the field of display technology, and in particular, to a pixel driving circuit, a pixel driving method, and a display device.

BACKGROUND

Organic Light Emitting Diode (OLED), as a current-type light emitting device, is increasingly used in high-performance display fields due to its self-luminous, fast response, wide viewing angle, and ability to be fabricated on flexible substrates. OLED display devices can be classified into two types: PMOLED (Passive Matrix Driving OLED) and AMOLED (Active Matrix Driving OLED). As the AMOLED display has the advantages of low manufacturing cost, high response speed, power saving, DC drive for portable equipment, wide operating temperature range and so on, AMOLED has received increasing attention from display technology developers.

It should be noted that the information disclosed in the background section above is only for enhancing the understanding of the background of the present disclosure, and thus may include information that does not constitute prior art known to those of ordinary skill in the art.

SUMMARY

The present disclosure provides a pixel driving circuit, a pixel driving method, and a display device.

According to an aspect of the present disclosure, a pixel driving circuit for driving an electroluminescent element is provided, including:

a first switching element having a control end receiving a first scan signal and a first end receiving an initialization signal;

a second switching element having a control end receiving the first scan signal and a first end receiving the initialization signal;

a third switching element having a control end receiving a second scan signal, a first end receiving a data signal, and a second end connected to a second end of the second switching element;

a fourth switching element having a control end receiving the second scan signal, and a first end connected to a second end of the first switching element;

a fifth switching element having a control end receiving a third scan signal, a first end receiving the initialization signal, and a second end connected to the second end of the second switching element;

a driving transistor having a control end connected to the second end of the first switching element, a first end receiving a first power signal, and a second end connected to a second end of the fourth switching element;

a sixth switching element having a control terminal receiving a control signal, a first end connected to the second end of the driving transistor, and a second end connected to the first electrode of the electroluminescent element;

a first storage capacitor having a first end connected to the second end of the third switching element, and a second end connected to the control end of the driving transistor; and a second storage capacitor having a first end connected to the control end of the driving transistor, and a second end connected to the first end of the driving transistor.

According to another aspect of the present disclosure, a pixel driving method for driving the pixel driving circuit of any of the above is provided, the pixel driving method includes:

in an initialization phase, the first switching element and the second switching element are turned on by the first scan signal, so that the initialization signal is transmitted to the control end of the driving transistor and the first end of the first storage capacitor through the first switching element and the second switching element, respectively;

in a compensation phase, the third switching element and the fourth switching element are turned on by the second scan signal, so that the data signal is transmitted to the first end of the first storage capacitor through the third switching element, and the first power signal and a threshold voltage of the driving transistor are written to the control end of the driving transistor;

in a data voltage writing phase, the fifth switching element is turned on by the third scan signal, so that the initialization signal is transmitted to the first end of the first storage capacitor through the fifth switching element; and in a driving phase, the sixth switching element is turned on by using the control signal, so that the driving transistor is turned on under control of a voltage of the second storage capacitor and outputs a driving current under the action of the first power signal, and the driving current flows through the sixth switching element to drive the electroluminescent element to emit light.

According to still another aspect of the present disclosure, a display device is provided, comprising the pixel driving circuit of any of the above.

BRIEF DESCRIPTION OF THE DRAWINGS

The above and other features and advantages of the present disclosure will become more apparent by the detailed description of exemplary embodiments thereof with referring to the accompanying drawings. Obviously, the drawings in the following description are only some of the embodiments of the present disclosure, and other drawings may be obtained according to the drawing without creative labor to those skilled in the art. In the drawing.

DETAILED DESCRIPTION

Figure 1:
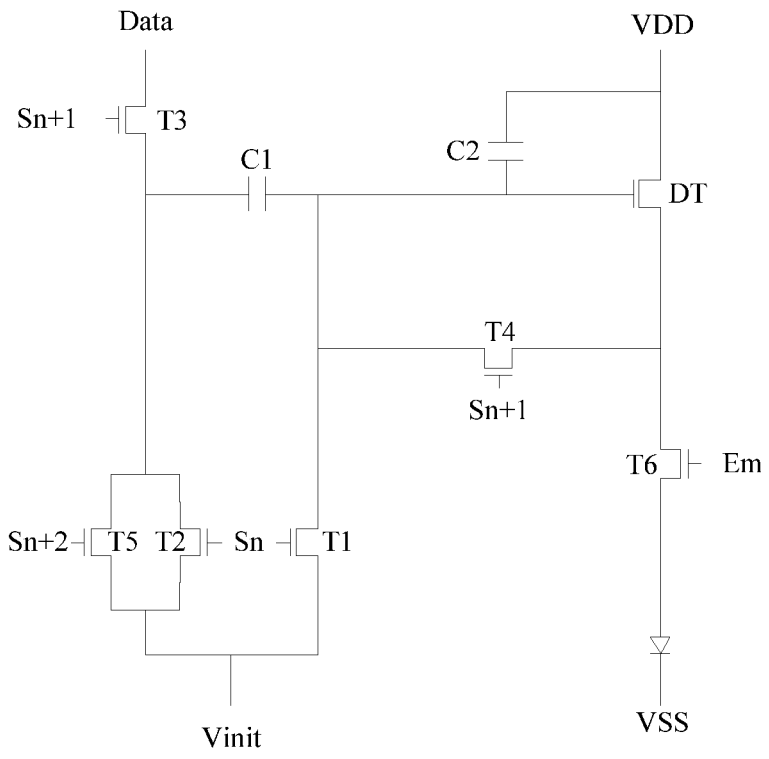
FIG. 1 is a schematic diagram 1 of a pixel driving circuit provided in an exemplary embodiment of the present disclosure.

Exemplary embodiments will now be described more fully with reference to the accompanying drawings. However, the exemplary embodiments can be implemented in a variety of forms and should not be construed as being limited to the embodiments set forth herein; rather, these embodiments are provided so that the present disclosure will be thorough and complete, and the concept of the exemplary embodiments is fully conveyed to those skilled in the art. The described features, structures, or characteristics may be combined in any suitable manner in one or more embodiments. In the following description, numerous specific details are set forth to provide a thorough understanding of the embodiments of the present disclosure. However, one skilled in the art will realize that the technical solution of the present disclosure may be practiced without one or more of the specific details, or other methods, components, materials, devices, steps, etc. may be employed. In other cases, well-known technical solutions are not shown or described in detail to avoid obscuring each of the aspects of the present disclosure.

In addition, the drawings are merely schematic illustrations of the present disclosure, and are not necessarily drawn to scale. The same reference numerals in the drawings denote the same or similar parts, and the repeated description thereof will be omitted.

In most AMOLED display panels, each OLED relies on a driving circuit composed of a plurality of TFT (Thin Film Transistor) switches in one pixel unit on the array substrate to drive to emit light for display.

However, as AMOLED display panels are moving toward higher resolution or larger sizes, a larger number of pixels and longer wires are required, and the wire sheet resistance and total resistance are also increasing. The difference in resistance of the wires makes the power voltage obtained by each pixel circuit different, so that different pixels have different current and brightness outputs under the same data signal voltage input, resulting in uneven display brightness of the panel.

In the present exemplary embodiment, a pixel driving circuit for driving an electroluminescent element is provided, referring to FIG. 1, the pixel driving circuit may include: a first switching element T1, a second switching element T2, a third switching element T3, a fourth switching element T4, a fifth switching element T5, a driving transistor DT, a sixth switching element T6, a first storage capacitor C1 and a second storage capacitor C2.

The control end of the first switching element T1 receives the first scan signal Sn, the first end of the first switching element T1 receives the initialization signal Vinit;

The control end of the second switching element T2 receives the first scan signal Sn, the first end of the second switching element T2 receives the initialization signal Vinit;

The control end of the third switching element T3 receives the second scan signal Sn+1, the first end of the third switching element T3 receives the data signal Data, and the second end of the third switching element T3 is connected to the second end of the second switching element T2;

The control end of the fourth switching element T4 receives the second scan signal Sn+1, and the first end of the fourth switching element T4 is connected to the second end of the first switching element T1;

The control end of the fifth switching element T5 receives the third scan signal Sn+2, the first end of the fifth switching element T5 receives the initialization signal Vinit, and the second end of the fifth switching element T5 is connected to the second end of the switching element T2;

The control end of the driving transistor DT is connected to the second end of the first switching element T1, the first end of the driving transistor DT receives the first power signal VDD, and a second end of the driving transistor DT is connected to the second end of the fourth switching element T4;

The control end of the sixth switching element T6 receives the control signal Em, the first end of the sixth switching element T6 is connected to the second end of the driving transistor DT, the second end of the sixth switching element T6 is connected to the first electrode of the electroluminescent element, the second electrode of the electroluminescent element receives the second power signal VSS;

The first end of the first storage capacitor C1 is connected to the second end of the third switching element T3, and the second end of the first storage capacitor C1 is connected to the control end of the driving transistor DT;

The first end of the second storage capacitor C2 is connected to the control end of the driving transistor DT, and the second end of the second storage capacitor C2 is connected to the first end of the driving transistor DT.

In the present exemplary embodiment, the electroluminescent element is a current-driven electroluminescent element that is controlled to emit light by a current flowing through the driving transistor DT, for example, an OLED, but the electroluminescent element in the present exemplary embodiment is not limited thereto.

A pixel driving circuit provided in an exemplary embodiment of the present disclosure includes first to sixth switching elements T1 to T6, a driving transistor DT, a first storage capacitor C1, and a second storage capacitor C2. In the operating process of the pixel driving circuit, on the one hand, since the third scan signal Sn+2 is added and the two ends of the second storage capacitor C2 are respectively connected to the control end and the first end of the driving transistor DT, in the driving phase, the first end of the first storage capacitor C1 is floating, and the abrupt change of the first power signal VDD is mirrored to the first end of the second storage capacitor C2, so that the voltage difference between the control end and the first end of the driving transistor DT is kept constant to ensure that the output current is consistent, thus eliminating the influence of the IR drop of the power line on the display brightness, and ensuring the uniformity of the display brightness of each pixel; and on the other hand, the first switching element T1 and the second switch are turned on by the first scan signal Sn, so that the initialization signal Vinit is respectively transmitted to the control end of the driving transistor DT and the first end of the first storage capacitor C1, and initializes the control ends of the first storage capacitor C1, the second storage capacitor C2, and the driving transistor DT, thus eliminating the influence of residual signals from the previous frame.

Figure 2:
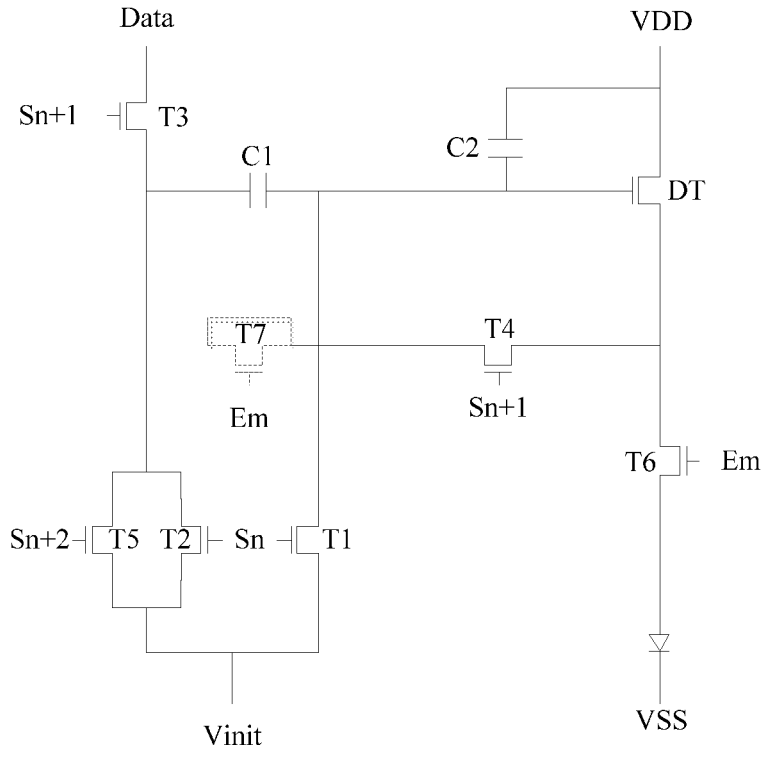
FIG. 2 is a schematic diagram 2 of a pixel driving circuit provided in an exemplary embodiment of the present disclosure.

On this basis, referring to FIG. 2, the pixel driving circuit may further include a seventh switching element T7.

The control end of the seventh switching element T7 receives the control signal Em, and the first end of the seventh switching element T7 and the second end of the seventh switching element T7 are both connected to the second end of the first storage capacitor C1, so that the seventh switching element T7 compensates for the offset of the threshold voltage of the driving transistor DT generated by the charge transfer when the fourth switching element T4 is hopped in the driving phase.

Figure 3:
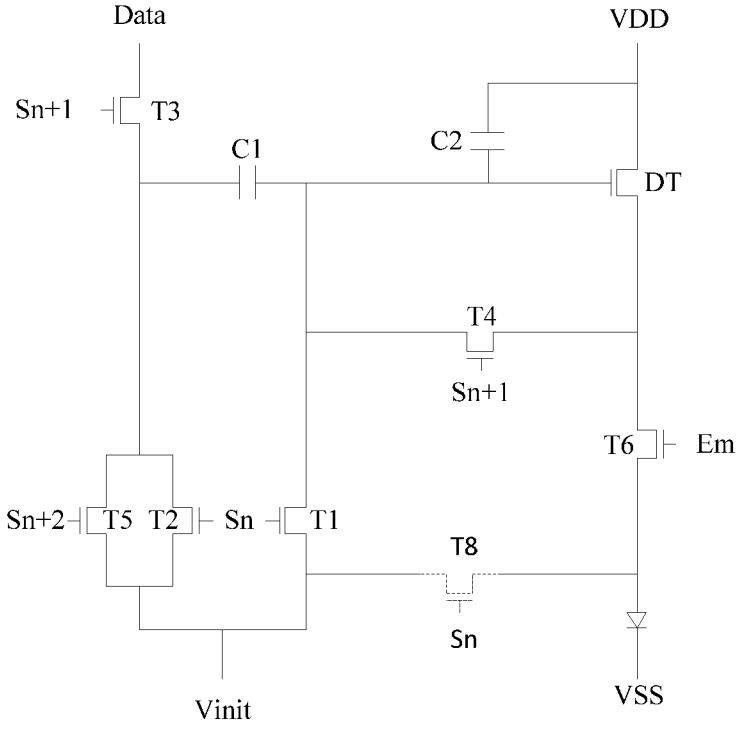
FIG. 3 is a schematic diagram 3 of a pixel driving circuit provided in an exemplary embodiment of the present disclosure.

Based on this, referring to FIG. 3, the pixel driving circuit may further include an eighth switching element T8.

The control end of the eighth switching element T8 receives the first scan signal Sn, the first end of the eighth switching element T8 receives the initialization signal Vinit, and the second end of the eighth switching element T8 is connected to the first electrode of the electroluminescent element. In the initialization phase, the eighth switching element T8 is turned on by the first scan signal Sn, so that the initialization signal Vinit is transmitted to the first electrode of the electroluminescent element through the eighth switching element T8 to lower the voltage difference between the first electrode and the second electrode of the electroluminescent element and reduce the brightness of the electroluminescent element at low gray levels and improve the contrast of the pixels.

In the present exemplary embodiment, the first to eighth switching elements T1 to T8 may correspond to the first to eighth transistors, respectively, each having a control end, a first end, and a second end. Specifically, the control end of each transistor may be a gate, the first end may be a source, and the second end may be a drain; or, the control end of each transistor may be a gate, and the first end may be a drain, the second end may be a source. In addition, each transistor may be an enhancement transistor or a depletion transistor, which is not particularly limited in this exemplary embodiment.

On the basis of this, all of the switching elements may be N-type thin film transistors, in this case, the driving voltages of all the switching elements are high level, and the first power signal VDD may be at a high level, the second electrode of the electroluminescent element can receive a low level signal, that is, the second power signal VSS may be at a low level, the first electrode of the electroluminescent element is a anode, the second electrode of the electroluminescent element is a cathode.

Alternatively, all of the switching elements may also be P-type thin film transistors, in this case, the driving voltages of all the switching elements are low level, the first power VDD may be low level, and the second electrode of the electroluminescence element can receive a high level signal, that is, the second power signal VSS can be high level. The first electrode of the electroluminescent element is a cathode, the second electrode of the electroluminescent element is an anode.

In an exemplary embodiment of the present disclosure, a pixel circuit driving method for driving a pixel driving circuit is also provided as shown in FIG. 1.

Next, the operation process of the pixel driving circuit of FIG. 1 will be described in detail in conjunction with the operation timing chart of the pixel driving circuit shown in FIG. 4, taking all switching elements as P-type thin film transistors as an example. Since all the switching elements are P-type thin film transistors, the on-signals of all of the switching elements is low level. The first power signal VDD is at a low level, and the second power signal VSS is at a high level. The driving timing chart shows the first scan signal Sn, the second scan signal Sn+1, the third scan signal Sn+2, the control signal Em, and the data signal Data.

Figure 5:
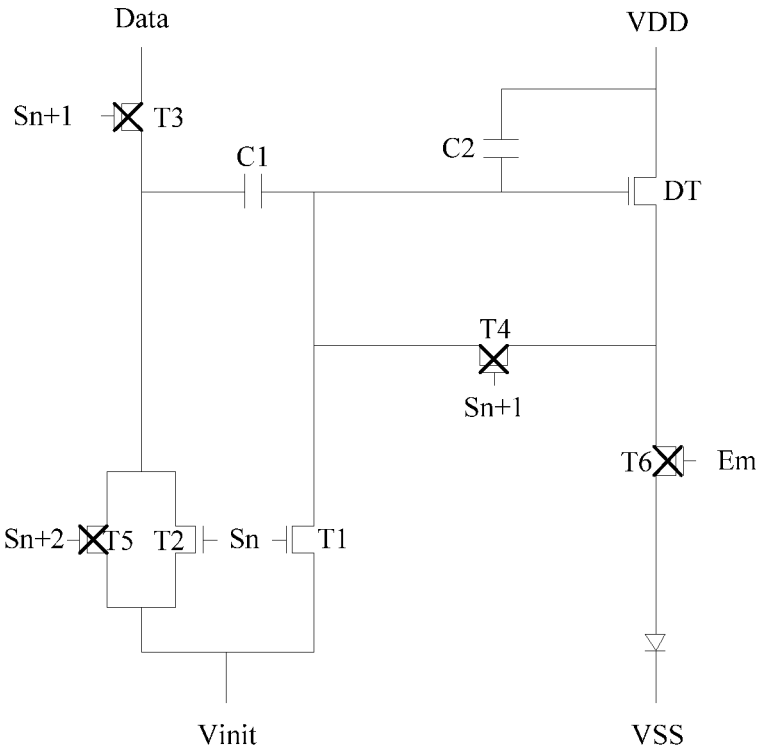
FIG. 5 is an equivalent circuit diagram 1 of a pixel driving circuit in an initialization phase provided in an exemplary embodiment of the present disclosure.

In the initialization phase (i.e., the first time period t1), the first switching element T1 and the second switching element T2 are turned on by the first scan signal Sn, so that the initialization signal Vinit is transmitted to the control end of the driving transistor DT and the first end of the first storage capacitor C1 through the first switching element T1 and the second switching element T2, respectively. In the present exemplary embodiment, the first scan signal Sn is at a low level, the second scan line Sn+1 is at a high level, the third scan line Sn+2 is at a high level, and the control signal Em is at a high level, as shown in FIG. 5, the first switching element T1 and the second switching element T2 are turned on, and the third to sixth switching elements T3 to T6 are turned off; the initialization signal Vinit is transmitted to the control end of the driving transistor DT (i.e., the first end of the second storage capacitor C2) and the first end of the first storage capacitor C1 through the first switching element T1 and the second switching element T2, respectively, initializing the first storage capacitor C1, the second storage capacitor C2, and the control end of the drive transistor DT, thus eliminating the influence of the residual signal of the previous frame.

Figure 6:
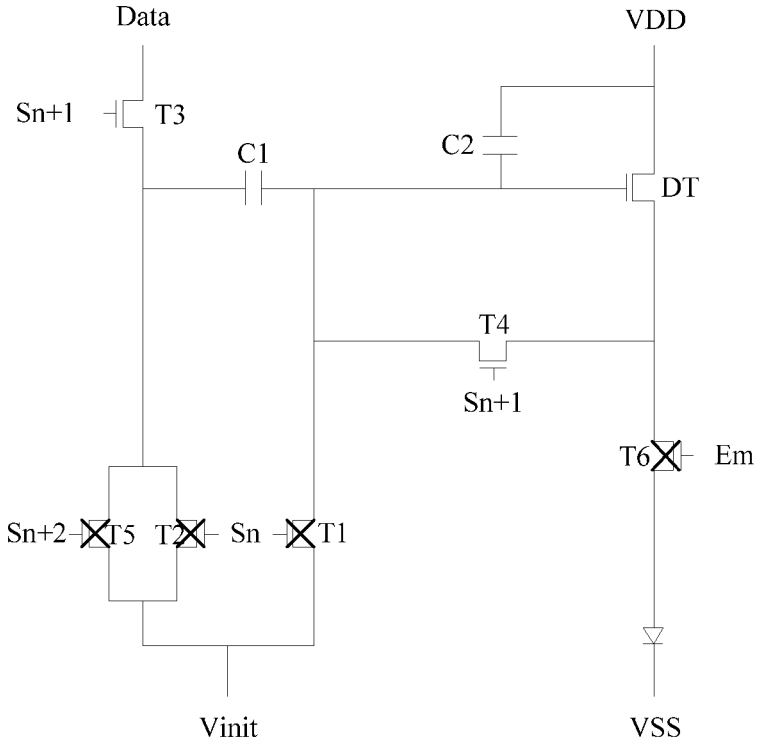
FIG. 6 is an equivalent circuit diagram of a pixel driving circuit in a compensation phase provided in an exemplary embodiment of the present disclosure.

In the compensation phase (i.e., the first time period t2), the third switching element T3 and the fourth switching element T4 are turned on by the second scan signal Sn+1, so that the data signal Data is transmitted to the first end of the first storage capacitor C1 through the third switching element T3, and the first power signal and the threshold voltage of the driving transistor DT is written into the control end of the driving transistor DT. In the present exemplary embodiment, the first scan signal Sn is at a high level, the second scan line Sn+1 is at a low level, the third scan line Sn+2 is at a high level, and the control signal Em is at a high level, as shown in FIG. 6, the third switching element T3 and the fourth switching element T4 are turned on, the first to second switching elements T1 to T2 and the fifth to sixth switching elements T5 to T6 are turned off; the data signal Data is at a high level, and is written to the first end of the first storage capacitor C1 through the third switching element T3, therefore, the voltage of the first end of the first storage capacitor C1 becomes Data; since the fourth switching element T4 is turned on, the control end of the driving transistor DT is connected to the second end of the driving transistor DT, so the potential of the control end of the driving transistor DT (i.e., the potential of the second end of the first storage capacitor C1 and the potential of the first end of the second storage capacitor C2) becomes VDD+Vth, Wherein, Vth is the threshold voltage of the drive transistor DT.

Figure 7:
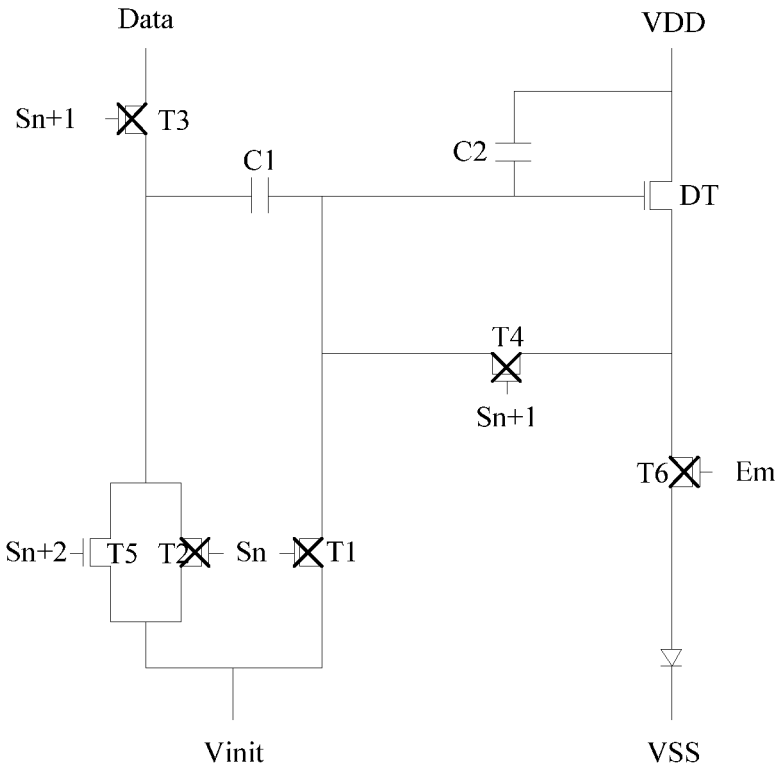
FIG. 7 is an equivalent circuit diagram of a pixel driving circuit in a data voltage writing phase provided in an exemplary embodiment of the present disclosure.

In the data voltage writing phase (i.e., the first time period t3), the fifth switching element T5 is turned on by the third scan signal Sn+2, so that the initialization signal Vinit is transmitted to the first end of the first storage capacitor C1 through the fifth switching element T5. In the present exemplary embodiment, the first scan signal Sn is at a high level, the second scan line Sn+1 is at a high level, the third scan line Sn+2 is at a low level, and the control signal Em is at a high level, as shown in FIG. 7, the fifth switching element T5 is turned on, the first to fourth switching elements T1 to T4 and the sixth switching element T6 are turned off; the initialization signal Vinit is transmitted to the first storage capacitor C1 through the fifth switching element T5, making the voltage of the first end of the first storage capacitor C1 change from Data to Vinit. Since the second end of the first storage capacitor C1 (i.e., the control end of the driving transistor DT and the first end of the second storage capacitor C2) is floating, and the first storage capacitor C1 and the second storage capacitor C2 have a voltage dividing effect, therefore, the potential of the second end of the first storage capacitor C1 (i.e., the potential of the control end of the driving transistor DT and the potential of the first end of the second storage capacitor C2) jumps to VDD+Vth+(C1/(C1+C2)) (Vinit-Data).

Figure 8:
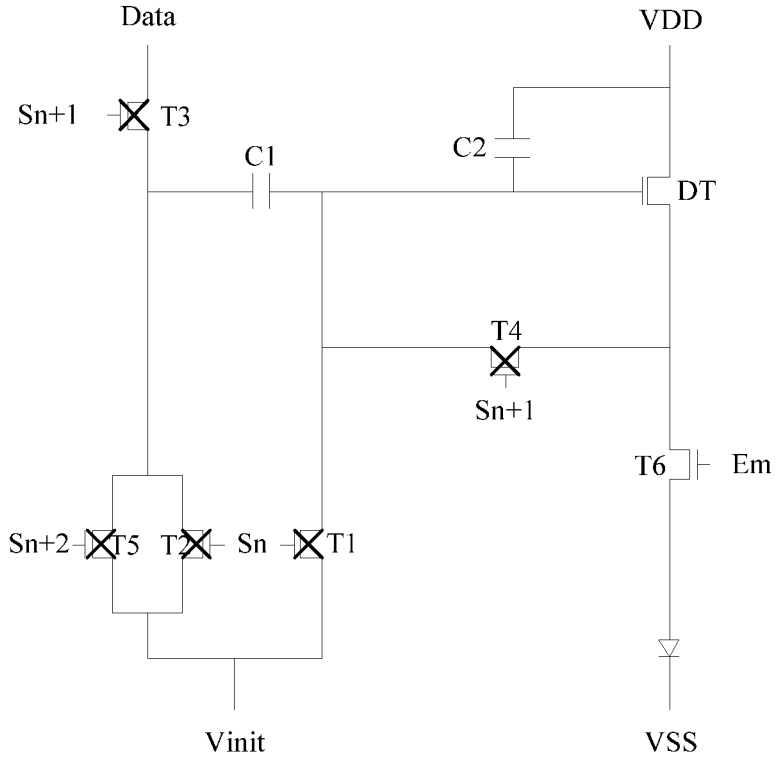
FIG. 8 is an equivalent circuit diagram 1 of a pixel driving circuit in a driving phase provided in an exemplary embodiment of the present disclosure.

In the driving phase (i.e., the first time period t4), the sixth switching element T6 is turned on by using the control signal Em, so that the driving transistor DT is turned on under the control of the voltage of the second storage capacitor C2 and outputs a driving current under the action of the first power signal VDD, and flows through the sixth switching element T6 to drive the electroluminescent element to emit light. In the present exemplary embodiment, the first scan signal Sn is at a high level, the second scan line Sn+1 is at a high level, the third scan line Sn+2 is at a high level, and the control signal Em is at a low level, as shown in FIG. 8, the sixth switching element T6 is turned on, and the first to fifth switching elements T1 to T5 are turned off; at this time, the first end of the sixth switching element T6 is electrically coupled with the second end of the sixth switching element T6, the potential of the first end of the driving transistor DT is VDD, and the voltage of the control end of the driving transistor DT is the potential of the second terminal of the first storage capacitor C1VDD+Vth+(C1/(C1+C2))(Vinit-Data).

Based on this, the calculation formula of the driving current according to the driving transistor DT:

$$\begin{aligned} \text{Ion} &= K \times (Vgs - Vth)2 = K \times (Vg - Vs - Vth)^2 \\ &= K \times (VDD + Vth + (C1/(C1 + C2))(Vinit\text{-Data}) - VDD - Vth)^2 \\ &= K \times (C1/(C1 + C2))(Vinit\text{-Data})^2 \end{aligned}$$

Wherein, Vgs is the voltage difference between the gate and the source of the driving transistor DT, Vg is the gate voltage of the driving transistor DT, and Vs is the source voltage of the driving transistor.

It can be seen that the driving current of the driving transistor DT is independent of the threshold voltage Vth of the driving transistor DT and the voltage of the first power signal VDD. Since the third scan signal Sn+2 is added and both ends of the second storage capacitor C2 are respectively connected to the control end and the first end of the driving transistor DT, in the driving phase, the first end of the first storage capacitor C1 is floating, and the abrupt change of the first power signal VDD is mirrored to the first end of the second storage capacitor C2, so that the voltage difference between the control end and the first end of the driving transistor DT is kept constant to ensure that the output current is consistent, thus eliminating the influence of the IR drop of the power line on the display brightness, and ensuring the uniformity of the display brightness of each pixel.

Using the thin film transistors that are all P-type has the following advantages: for example, strong noise suppression; for example, the low level in charge management is easy to implement due to low-level conduction; for example, the process of a P-type thin film transistor is simple and relatively low in price; for example, P-type thin film transistors have better stability and the like.

Figure 4:
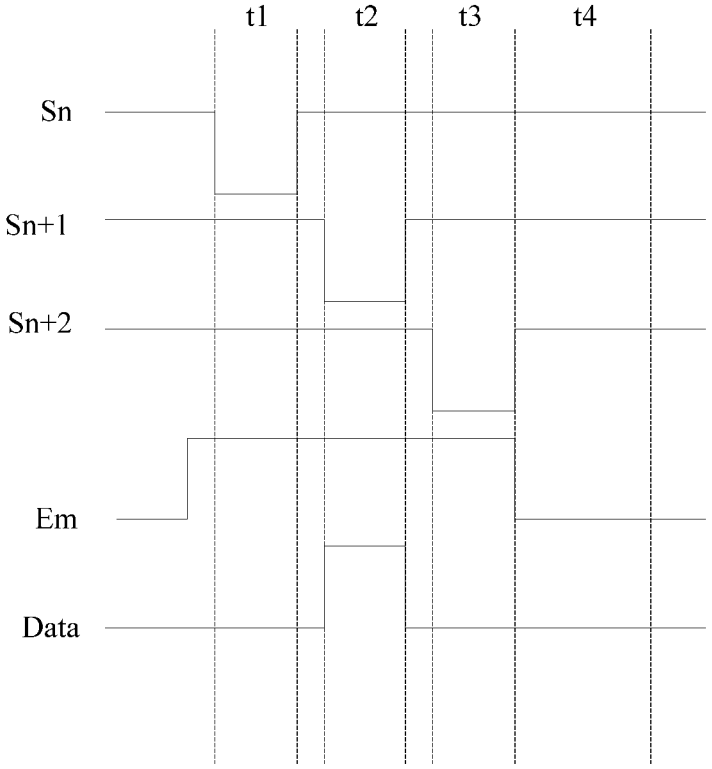
FIG. 4 is an operation timing diagram of a pixel driving circuit provided in an exemplary embodiment of the present disclosure.

When different signals hop at the same time, different signals may affect each other, in order to avoid the above phenomenon, as shown in FIG. 4, there may be a hold phase between the initialization phase (i.e., the first time period t1) and the compensation phase (i.e., the first time period t2) to allow different signals to hop at different times, thereby avoiding the above phenomenon. Similarly, there may be a hold phase between the compensation phase (i.e., the first time period t2) and the data voltage writing phase (i.e., the first time period t3) to allow different signals to hop at different times.

Figure 9:
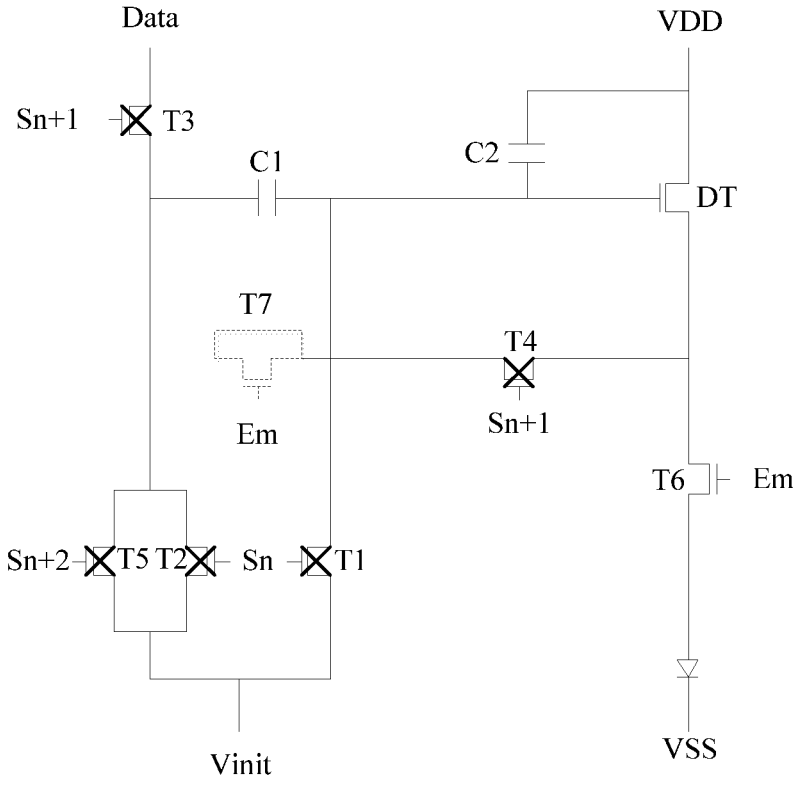
FIG. 9 is an equivalent circuit diagram 2 of a pixel driving circuit in a driving phase provided in an exemplary embodiment of the present disclosure.

On the basis of FIG. 1, the pixel driving circuit may further include: a seventh switching element T7, the control end of the seventh switching element T7 receives the control signal Em, and the first end of the seventh switch of the seventh switching element T7 and the second end of the seventh switching element T7 is connected to the second end of the first storage capacitor C1 (as shown in FIG. 2). The pixel driving method may further include: in the driving phase (i.e., the first time period t4), as shown in FIG. 9, the seventh switching element T7 is turned on by the control signal Em, so that the seventh switching element T7 compensates for the offset of the threshold voltage caused by the charge transfer when the fourth switching element T4 is hopped.

Figure 10:
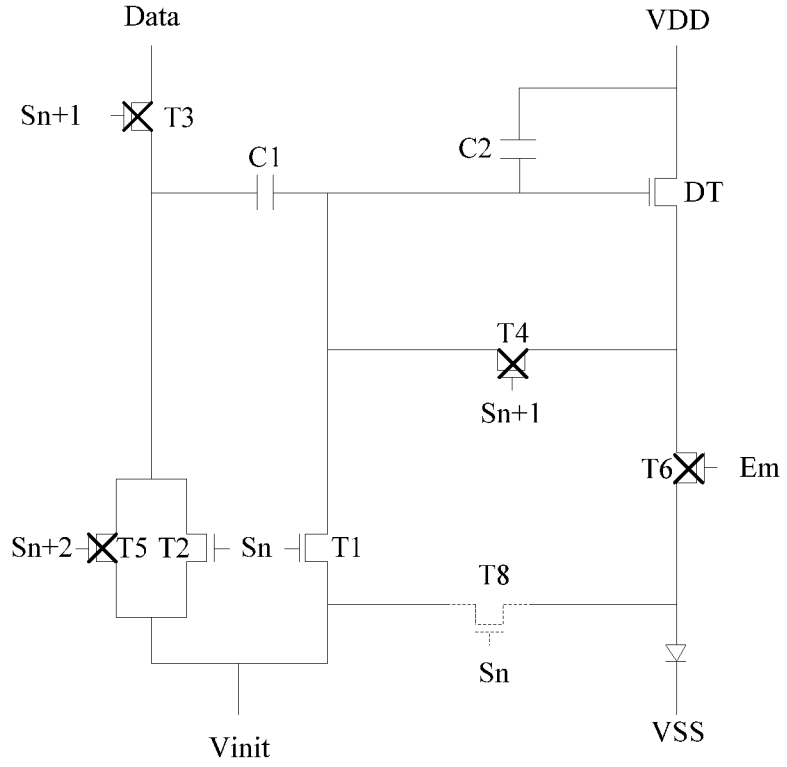
FIG. 10 is an equivalent circuit diagram 2 of a pixel driving circuit in an initialization phase provided in an exemplary embodiment of the present disclosure.

On the basis of FIG. 1, the pixel driving circuit further includes: an eighth switching element T8, the control end of the eighth switching element T8 receives the first scan signal Sn, and the first end of the eighth switching element T8 receives the initialization signal Vinit, the second end of the eighth switching element T8 is connected to the first electrode of the electroluminescent element (as shown in FIG. 3); the pixel driving method further includes: in the initialization phase (i.e., the first time period t1), as shown in FIG. 10, the eighth switching element T8 is turned on by the first scan signal Sn, so that the initialization signal Vinit is transmitted to the first electrode of the electroluminescence element through the eighth switching element T8 to lower the voltage difference between the first electrode and the second electrode of the electroluminescent element and reduce the brightness of the electroluminescent element at low gray levels and improve the contrast of the pixels.

It should be noted that, in the foregoing specific embodiments, all the switching elements are P-type thin film transistors; however, those skilled in the art can easily obtain a pixel driving circuit in which all switching elements are N-type thin film transistors according to the pixel driving circuit provided by the present disclosure. In an exemplary embodiment of the present disclosure, all of the switching elements may be N-type thin film transistors, and since all of the switching elements are N-type thin film transistors, therefore, the on-signal of all of the switching elements are high. The first power signal VDD is at a high level, and the second power signal VSS is at a low level. Of course, the pixel driving circuit provided by the present disclosure may be changed to a CMOS (Complementary Metal Oxide Semiconductor) circuit or the like, and is not limited to the pixel driving circuit provided in the present embodiment, and details are not described herein again.

The example embodiment also provides a display device including the above-described pixel driving circuit. The display device includes: a plurality of scan lines for providing scan signals; a plurality of data lines for providing data signals; and a plurality of pixel drive circuits electrically connected to the scan lines and the data lines; wherein at least one of the pixels driving circuit includes any of the above-described pixel driving circuits in the present exemplary embodiment. Since the abrupt change of the first power signal VDD is mirrored to the first end of the second storage capacitor C2, the voltage difference between the control end and the first end of the driving transistor DT is kept constant to ensure that the output current is consistent, and eliminate the influence of the IR drop of the power line on the display brightness, ensuring the uniformity of the display brightness of each pixel, thereby greatly improving the display quality. Wherein, the display device may include any product or component having a display function, such as a mobile phone, a tablet computer, a television, a notebook computer, a digital photo frame, a navigator, and the like.

It should be noted that the specific details of each module unit in the display device have been described in detail in the corresponding pixel driving circuit, and thus will not be described herein.

It should be noted that although several modules or units of equipment for action execution are mentioned in the detailed description above, such division is not compellent. In actually, features and functions of two or more of the modules or units described above may be embodied in one module or unit in accordance with the embodiments of the present disclosure. Conversely, the features and functions of one module or unit described above may be further divided into multiple modules or units.

In addition, although the various steps of the method of the present disclosure are described in a particular order in the drawings, it is not required or implied that the steps must be performed in the specific order, or all the steps shown must be performed to achieve the desired result. Additionally or alternatively, certain steps may be omitted, multiple steps may be combined into one step for execution, and/or one step may be decomposed into multiple steps for executions and the like.

Other embodiments of the invention will be readily apparent to those skilled in the art upon consideration of the specification and practice of the invention herein disclosed herein. The present application is intended to cover any variations, uses, or adaptations of the present invention, which are in accordance with the general principles of the present invention and include common general knowledge or conventional technical means in the art that are not disclosed in the present invention. The specification and examples are to be considered as illustrative only, the true scope and spirit of the invention is pointed out by the following claims.

What is claimed is:

1. A pixel driving circuit for driving an electroluminescent element, comprising a first switching element having a control end receiving a first scan signal and a first end receiving an initialization signal;

a second switching element having a control end receiving the first scan signal and a first end receiving the initialization signal;

a third switching element having a control end receiving a second scan signal, a first end receiving a data signal, and a second end connected to a second end of the second switching element;

a fourth switching element having a control end receiving the second scan signal, and a first end connected to a second end of the first switching element;

a fifth switching element having a control end receiving a third scan signal, a first end receiving the initialization signal, and a second end connected to the second end of the second switching element;

a driving transistor having a control end connected to the second end of the first switching element, a first end receiving a first power signal, and a second end connected to a second end of the fourth switching element;

a sixth switching element having a control terminal receiving a control signal, a first end connected to the second end of the driving transistor, and a second end connected to the first electrode of the electroluminescent element;

a first storage capacitor having a first end connected to the second end of the third switching element, and a second end connected to the control end of the driving transistor; and a second storage capacitor having a first end connected to the control end of the driving transistor, and a second end connected to the first end of the driving transistor, wherein the third scan signal is a signal different from the control signal, and wherein the second end of the second switching element is connected directly to the first end of the first storage capacitor, and the second end of the first switching element is connected directly to the second end of the first storage capacitor.

2. The pixel driving circuit of claim 1, further comprising:

a seventh switching element having a control end receiving the control signal, and a first end and a second end both connected directly to the second end of the first storage capacitor.

3. The pixel driving circuit of claim 1, further comprising:

an eighth switching element having a control end receiving the first scan signal, a first end receiving the initialization signal, and a second end connected to the first electrode of the electroluminescent element.

4. The pixel driving circuit according to claim 1, wherein all of the switching elements are N-type thin film transistors, the first power signal is at a high level, and the second electrode of the electroluminescent element receives a low level signal.

5. The pixel driving circuit according to claim 1, wherein all of the switching elements are P-type thin film transistors, the first power signal is at a low level, and the second electrode of the electroluminescent element receives a high level signal.

6. A display device, comprising:

a plurality of scan lines configured to provide scan signals;

a plurality of data lines configured to provide data signals; and a plurality of pixel drive circuits electrically connected to the scan lines and the data lines, wherein at least one of the pixel driving circuit comprises the pixel driving circuit according to claim 1.

7. The display device according to claim 6, wherein the pixel driving circuit further comprises:

a seventh switching element having a control end receiving the control signal, and a first end and a second end both connected directly to the second end of the first storage capacitor.

8. The display device according to claim 6, wherein the pixel driving circuit further comprises an eighth switching element having a control end receiving the first scan signal, a first end receiving the initialization signal, and a second end connected to the first electrode of the electroluminescent element.

9. The display device according to claim 6, wherein all of the switching elements are N-type thin film transistors, the first power signal is at a high level, and the second electrode of the electroluminescent element receives a low level signal.

10. The display device according to claim 6, wherein all of the switching elements are P-type thin film transistors, the first power signal is at a low level, and the second electrode of the electroluminescent element receives a high level signal.

11. The pixel driving circuit according to claim 1, wherein the electroluminescent element is a current-driven electroluminescent element.

12. The pixel driving circuit according to claim 1, wherein the electroluminescent element is an OLED.

13. The pixel driving circuit according to claim 1, wherein the first switching element and the second switching element are is configured to be turned on under control of the first scan signal during an initialization phase.

14. The pixel driving circuit according to claim 1, wherein the third switching element and the fourth switching element are configured to be turned on by the second scan signal during a compensation phase.

15. The pixel driving circuit according to claim 1, wherein the fifth switching element is configured to be turned on by the third scan signal during a data voltage writing phase.

16. The pixel driving circuit according to claim 1, wherein the sixth switching element is configured to be turned on by using the control signal during a driving phase.

17. A pixel driving method for driving a pixel driving circuit for driving an electroluminescent element, the pixel driving circuit comprising, a first switching element having a control end receiving a first scan signal and a first end receiving an initialization signal, a second switching element having a control end receiving the first scan signal and a first end receiving the initialization signal; a third switching element having a control end receiving a second scan signal, a first end receiving a data signal, and a second end connected to a second end of the second switching element; a fourth switching element having a control end receiving the second scan signal, and a first end connected to a second end of the first switching element; a fifth switching element having a control end receiving a third scan signal, a first end receiving the initialization signal, and a second end connected to the second end of the second switching element; a driving transistor having a control end connected to the second end of the first switching element, a first end receiving a first power signal, and a second end connected to a second end of the fourth switching element; a sixth switching element having a control terminal receiving a control signal, a first end connected to the second end of the driving transistor, and a second end connected to the first electrode of the electroluminescent element; a first storage capacitor having a first end connected to the second end of the third switching element, and a second end connected to the control end of the driving transistor; and a second storage capacitor having a first end connected to the control end of the driving transistor, and a second end connected to the first end of the driving transistor wherein, the pixel driving method comprises:

in an initialization phase, the first switching element and the second switching element are turned on by the first scan signal, so that the initialization signal is transmitted to the control end of the driving transistor and the first end of the first storage capacitor through the first switching element and the second switching element, respectively;

in a compensation phase, the third switching element and the fourth switching element are turned on by the second scan signal, so that the data signal is transmitted to the first end of the first storage capacitor through the third switching element, and the first power signal and a threshold voltage of the driving transistor are written to the control end of the driving transistor;

in a data voltage writing phase, the fifth switching element is turned on by the third scan signal, so that the initialization signal is transmitted to the first end of the first storage capacitor through the fifth switching element; and in a driving phase, the sixth switching element is turned on by using the control signal, so that the driving transistor is turned on under control of a voltage of the second storage capacitor and outputs a driving current under the action of the first power signal, and the driving current flows through the sixth switching element to drive the electroluminescent element to emit light.

18. The pixel driving method of claim 17, wherein the pixel driving circuit further comprises:

a seventh switching element having a control terminal receiving the control signal, and a first end and a second end both connected to the second end of the first storage capacitor, wherein the pixel driving method further comprises:

in the driving phase, the seventh switching element is turned on by the control signal, so that the seventh switching element compensates a voltage offset due to charge transfer during hopping of the fourth switching element.

19. The pixel driving method of claim 17, wherein the pixel driving circuit further comprises an eighth switching element having a control end receiving the first scan signal, a first end receiving the initialization signal, and a second end connected to the first electrode of the electroluminescent element, wherein the pixel driving method further comprises:

in the initialization phase, the eighth switching element is turned on by the first scan signal, so that the initialization signal is transmitted to the first electrode of the electroluminescent element through the eighth switching element.

20. The pixel driving method according to claim 18, wherein on-signals of all of the switching elements are all at low level or all at high level.

* * * * *